US010850510B2

(12) United States Patent
Christenson et al.

(10) Patent No.: US 10,850,510 B2
(45) Date of Patent: Dec. 1, 2020

(54) SHUTTERING OF AEROSOL STREAMS

(71) Applicant: Optomec, Inc., Albuquerque, NM (US)

(72) Inventors: Kurt K. Christenson, Minnetonka, MN (US); Michael J. Renn, New Richmond, WI (US); Jason A. Paulsen, Cedar Rapids, IA (US); John David Hamre, Plymouth, MN (US); Chad Conroy, Minneapolis, MN (US); James Q. Feng, Maple Grove, MN (US)

(73) Assignee: Optomec, Inc., Albuquerque, NM (US)

( * ) Notice: Subject to any disclaimer, the term of this patent is extended or adjusted under 35 U.S.C. 154(b) by 0 days.

(21) Appl. No.: 16/719,459

(22) Filed: Dec. 18, 2019

(65) Prior Publication Data

US 2020/0122461 A1 Apr. 23, 2020

Related U.S. Application Data

(62) Division of application No. 16/190,007, filed on Nov. 13, 2018, now Pat. No. 10,632,746.

(Continued)

(51) Int. Cl.

*B05B 1/30* (2006.01)
*B41J 2/11* (2006.01)

(Continued)

(52) U.S. Cl.

CPC . *B41J 2/11* (2013.01); *B05B 1/30* (2013.01); *B41J 2/175* (2013.01); *B05B 7/0012* (2013.01); *B05B 7/12* (2013.01); *B05B 12/18* (2018.02)

(58) Field of Classification Search

CPC ..... B05B 7/0012; B05B 12/18; B05D 1/30
See application file for complete search history.

(56) References Cited

U.S. PATENT DOCUMENTS 3,474,971 A 10/1969 Goodrich
3,590,477 A 7/1971 Cheroff et al.

(Continued)

FOREIGN PATENT DOCUMENTS

CN 2078199 6/1991
CN 1452554 10/2003

(Continued)

OTHER PUBLICATIONS

Webster's Ninth New Collegiate Dictionary, 1990, 744.

(Continued)

*Primary Examiner* — Cachet I Proctor

(74) *Attorney, Agent, or Firm* — Peacock Law P.C.; Philip D. Askenazy

(57) ABSTRACT

Methods and apparatuses for controlling aerosol streams being deposited onto a substrate via pneumatic shuttering. The aerosol stream is surrounded and focused by an annular co-flowing sheath gas in the print head of the apparatus. A boost gas flows to a vacuum pump during printing of the aerosol. A valve adds the boost gas to the sheath gas at the appropriate time, and a portion of the two gases is deflected in a direction opposite to the aerosol flow direction to at least partially prevent the aerosol from passing through the deposition nozzle. Some or all of the aerosol is combined with that portion of the boost gas and sheath gas and is exhausted from the print head. By precisely balancing the flows into and out of the print head, maintaining the flow rates of the aerosol and sheath gas approximately constant, and keeping the boost gas flowing during both printing and shuttering, the transition time between printing and partial or full shuttering of the aerosol stream is minimized. The pneumatic shuttering can be combined with a mechanical shutter for faster operation. A pre-sheath gas can be used to mini- (Continued)

mize the delay between the flow of gas in the center and the flow of gas near the sides of the print head flow channel.

11 Claims, 8 Drawing Sheets

Related U.S. Application Data

(60) Provisional application No. 62/585,449, filed on Nov. 13, 2017.

(51) Int. Cl.

| | |
|---|---|
| ***B41J 2/175*** | (2006.01) |
| *B05B 7/12* | (2006.01) |
| *B05B 12/18* | (2018.01) |
| *B05B 7/00* | (2006.01) |

(56) References Cited

U.S. PATENT DOCUMENTS

| | | | |
|---|---|---|---|
| 3,642,202 | A | 2/1972 | Angelo |
| 3,715,785 | A | 2/1973 | Brown et al. |
| 3,777,983 | A | 12/1973 | Hibbins |
| 3,808,550 | A | 3/1974 | Ashkin |
| 3,808,432 | A | 4/1974 | Ashkin |
| 3,816,025 | A | 6/1974 | O'Neill |
| 3,846,661 | A | 11/1974 | Brown et al. |
| 3,854,321 | A | 12/1974 | Dahneke |
| 3,901,798 | A | 8/1975 | Peterson |
| 3,959,798 | A | 5/1976 | Hochberg et al. |
| 3,974,769 | A | 8/1976 | Hochberg et al. |
| 3,982,251 | A | 9/1976 | Hochberg |
| 4,004,733 | A | 1/1977 | Law |
| 4,016,417 | A | 4/1977 | Benton |
| 4,019,188 | A | 4/1977 | Hochberg et al. |
| 4,034,025 | A | 7/1977 | Martner |
| 4,036,434 | A | 7/1977 | Anderson et al. |
| 4,046,073 | A | 9/1977 | Mitchell et al. |
| 4,046,074 | A | 9/1977 | Hochberg et al. |
| 4,073,436 | A | 2/1978 | Behr |
| 4,092,535 | A | 5/1978 | Ashkin et al. |
| 4,112,437 | A | 9/1978 | Mir et al. |
| 4,132,894 | A | 1/1979 | Yule |
| 4,171,096 | A | 10/1979 | Welsh et al. |
| 4,200,669 | A | 4/1980 | Schaefer et al. |
| 4,228,440 | A | 10/1980 | Horike et al. |
| 4,235,563 | A | 11/1980 | Hine et al. |
| 4,269,868 | A | 5/1981 | Livsey |
| 4,323,756 | A | 4/1982 | Brown et al. |
| 4,400,408 | A | 8/1983 | Asano et al. |
| 4,453,803 | A | 6/1984 | Hidaka et al. |
| 4,485,387 | A | 11/1984 | Drumheller |
| 4,497,692 | A | 2/1985 | Gelchinski et al. |
| 4,601,921 | A | 7/1986 | Lee |
| 4,605,574 | A | 8/1986 | Yonehara et al. |
| 4,670,135 | A | 6/1987 | Marple et al. |
| 4,685,563 | A | 8/1987 | Cohen et al. |
| 4,689,052 | A | 8/1987 | Ogren et al. |
| 4,694,136 | A | 9/1987 | Kasner et al. |
| 4,724,299 | A | 2/1988 | Hammeke |
| 4,733,018 | A | 3/1988 | Prabhu et al. |
| 4,823,009 | A | 4/1989 | Biemann et al. |
| 4,825,299 | A | 4/1989 | Okada et al. |
| 4,826,583 | A | 5/1989 | Biernaux et al. |
| 4,893,886 | A | 1/1990 | Ashkin et al. |
| 4,904,621 | A | 2/1990 | Loewenstein et al. |
| 4,911,365 | A | 3/1990 | Thiel et al. |
| 4,917,830 | A | 4/1990 | Ortiz et al. |
| 4,920,254 | A | 4/1990 | Decamp et al. |
| 4,927,992 | A | 5/1990 | Whitlow et al. |
| 4,947,463 | A | 8/1990 | Matsuda et al. |
| 4,971,251 | A | 11/1990 | Dobrick et al. |
| 4,978,067 | A | 12/1990 | Berger et al. |
| 4,997,809 | A | 3/1991 | Gupta |
| 5,032,850 | A | 7/1991 | Andeen et al. |
| 5,038,014 | A | 8/1991 | Pratt et al. |
| 5,043,548 | A | 8/1991 | Whitney et al. |
| 5,064,685 | A | 11/1991 | Kestenbaum et al. |
| 5,126,102 | A | 6/1992 | Takahashi et al. |
| 5,164,535 | A | 11/1992 | Leasure |
| 5,170,890 | A | 12/1992 | Wilson et al. |
| 5,173,220 | A | 12/1992 | Reiff et al. |
| 5,176,328 | A | 1/1993 | Alexander |
| 5,176,744 | A | 1/1993 | Muller |
| 5,182,430 | A | 1/1993 | Lagain |
| 5,194,297 | A | 3/1993 | Scheer et al. |
| 5,208,431 | A | 5/1993 | Uchiyama et al. |
| 5,245,404 | A | 9/1993 | Jannson et al. |
| 5,250,383 | A | 10/1993 | Naruse |
| 5,254,832 | A | 10/1993 | Gartner et al. |
| 5,270,542 | A | 12/1993 | McMurry et al. |
| 5,292,418 | A | 3/1994 | Morita et al. |
| 5,294,459 | A | 3/1994 | Hogan et al. |
| 5,306,447 | A | 4/1994 | Harris et al. |
| 5,322,221 | A | 6/1994 | Anderson |
| 5,335,000 | A | 8/1994 | Stevens |
| 5,343,434 | A | 8/1994 | Noguchi |
| 5,344,676 | A | 9/1994 | Kim et al. |
| 5,359,172 | A | 10/1994 | Kozak et al. |
| 5,366,559 | A | 11/1994 | Periasamy |
| 5,378,505 | A | 1/1995 | Kubota et al. |
| 5,378,508 | A | 1/1995 | Castro et al. |
| 5,393,613 | A | 2/1995 | MacKay |
| 5,398,193 | A | 3/1995 | Deangelis |
| 5,403,617 | A | 4/1995 | Haaland |
| 5,405,660 | A | 4/1995 | Psiuk et al. |
| 5,418,350 | A | 5/1995 | Freneaux et al. |
| 5,449,536 | A | 9/1995 | Funkhouser |
| 5,477,026 | A | 12/1995 | Buongiorno |
| 5,486,676 | A | 1/1996 | Aleshin |
| 5,491,317 | A | 2/1996 | Pirl |
| 5,495,105 | A | 2/1996 | Nishimura et al. |
| 5,512,745 | A | 4/1996 | Finer et al. |
| 5,518,680 | A | 5/1996 | Cima et al. |
| 5,524,828 | A | 6/1996 | Raterman et al. |
| 5,529,634 | A | 6/1996 | Miyata et al. |
| 5,547,094 | A | 8/1996 | Bartels et al. |
| 5,578,227 | A | 11/1996 | Rabinovich |
| 5,607,730 | A | 3/1997 | Ranalli |
| 5,609,921 | A | 3/1997 | Gitzhofer et al. |
| 5,612,099 | A | 3/1997 | Thaler |
| 5,614,252 | A | 3/1997 | McMillan et al. |
| 5,634,093 | A | 5/1997 | Ashida et al. |
| 5,648,127 | A | 7/1997 | Turchan et al. |
| 5,653,925 | A | 8/1997 | Batchelder |
| 5,676,719 | A | 10/1997 | Stavropoulos et al. |
| 5,697,046 | A | 12/1997 | Conley |
| 5,705,117 | A | 1/1998 | O'Connor et al. |
| 5,707,715 | A | 1/1998 | Derochemont et al. |
| 5,732,885 | A | 3/1998 | Huffman |
| 5,733,609 | A | 3/1998 | Wang |
| 5,736,195 | A | 4/1998 | Haaland |
| 5,742,050 | A | 4/1998 | Amirav et al. |
| 5,775,402 | A | 4/1998 | Sachs et al. |
| 5,746,844 | A | 5/1998 | Sterett et al. |
| 5,770,272 | A | 6/1998 | Biemann et al. |
| 5,772,106 | A | 6/1998 | Ayers et al. |
| 5,772,963 | A | 6/1998 | Prevost et al. |
| 5,772,964 | A | 6/1998 | Prevost et al. |
| 5,779,833 | A | 7/1998 | Cawley et al. |
| 5,795,388 | A | 8/1998 | Oudard |
| 5,814,152 | A | 9/1998 | Thaler |
| 5,837,960 | A | 11/1998 | Lewis et al. |
| 5,844,192 | A | 12/1998 | Wright et al. |
| 5,847,357 | A | 12/1998 | Woodmansee et al. |
| 5,849,238 | A | 12/1998 | Schmidt et al. |
| 5,854,311 | A | 12/1998 | Richart |
| 5,861,136 | A | 1/1999 | Glicksman et al. |
| 5,882,722 | A | 3/1999 | Kydd |
| 5,894,403 | A | 4/1999 | Shah et al. |
| 5,940,099 | A | 8/1999 | Karlinski |
| 5,958,268 | A | 9/1999 | Engelsberg et al. |
| 5,965,212 | A | 10/1999 | Dobson et al. |

(56) References Cited

U.S. PATENT DOCUMENTS 5,980,998 A 11/1999 Sharma et al.
5,993,549 A 11/1999 Kindler et al.
5,993,554 A 11/1999 Keicher et al.
5,997,956 A 12/1999 Hunt et al.
6,007,631 A 12/1999 Prentice et al.
6,015,083 A 1/2000 Hayes et al.
6,021,776 A 2/2000 Allred et al.
6,025,037 A 2/2000 Wadman et al.
6,036,889 A 3/2000 Kydd
6,040,016 A 3/2000 Mitani et al.
6,046,426 A 4/2000 Jeantette et al.
6,056,994 A 5/2000 Paz De Araujo et al.
6,110,144 A 8/2000 Choh et al.
6,116,718 A 9/2000 Peeters et al.
6,136,442 A 10/2000 Wong
6,143,116 A 11/2000 Hayashi et al.
6,144,008 A 11/2000 Rabinovich
6,149,076 A 11/2000 Riney
6,151,435 A 11/2000 Pilloff
6,159,749 A 12/2000 Liu
6,169,605 B1 1/2001 Penn et al.
6,176,647 B1 1/2001 Itoh
6,182,688 B1 2/2001 Fabre
6,183,690 B1 2/2001 Yoo et al.
6,197,366 B1 3/2001 Takamatsu
6,251,488 B1 6/2001 Miller et al.
6,258,733 B1 7/2001 Solayappan et al.
6,265,050 B1 7/2001 Wong et al.
6,267,301 B1 7/2001 Haruch
6,268,584 B1 7/2001 Keicher et al.
6,290,342 B1 9/2001 Vo et al.
6,291,088 B1 9/2001 Wong
6,293,659 B1 9/2001 Floyd et al.
6,318,642 B1 11/2001 Goenka et al.
6,328,026 B1 12/2001 Wang et al.
6,340,216 B1 1/2002 Peeters et al.
6,348,687 B1 2/2002 Brockmann et al.
6,349,668 B1 2/2002 Sun et al.
6,355,533 B2 3/2002 Lee
6,379,745 B1 4/2002 Kydd et al.
6,384,365 B1 5/2002 Seth et al.
6,390,115 B1 5/2002 Rohwer et al.
6,391,251 B1 5/2002 Keicher et al.
6,391,494 B2 5/2002 Reitz et al.
6,405,095 B1 6/2002 Jang et al.
6,406,137 B1 6/2002 Okazaki et al.
6,410,105 B1 6/2002 Mazumder et al.
6,416,156 B1 7/2002 Noolandi et al.
6,416,157 B1 7/2002 Peeters et al.
6,416,158 B1 7/2002 Floyd et al.
6,416,159 B1 7/2002 Floyd et al.
6,416,389 B1 7/2002 Perry et al.
6,454,384 B1 9/2002 Peeters et al.
6,467,862 B1 10/2002 Peeters et al.
6,471,327 B2 10/2002 Jagannathan et al.
6,481,074 B1 11/2002 Karlinski
6,486,432 B1 11/2002 Colby et al.
6,503,831 B2 1/2003 Speakman
6,513,736 B1 2/2003 Skeath et al.
6,520,996 B1 2/2003 Manasas et al.
6,521,297 B2 2/2003 McDougall et al.
6,537,501 B1 3/2003 Holl et al.
6,544,599 B1 4/2003 Brown et al.
6,548,122 B1 4/2003 Sharma et al.
6,564,038 B1 5/2003 Bethea et al.
6,572,033 B1 6/2003 Pullagura et al.
6,573,491 B1 6/2003 Marchitto et al.
6,607,597 B2 8/2003 James et al.
6,608,281 B2 8/2003 Ishide et al.
6,636,676 B1 * 10/2003 Renn ..... B82Y 10/00 385/11
6,646,253 B1 11/2003 Rohwer et al.
6,656,409 B1 12/2003 Keicher et al.
6,697,694 B2 2/2004 Mogensen
6,772,649 B2 8/2004 Zimmermann et al.
6,774,338 B2 8/2004 Baker et al.
6,780,377 B2 8/2004 Hall et al.
6,811,744 B2 11/2004 Keicher et al.
6,811,805 B2 11/2004 Gilliard et al.
6,823,124 B1 11/2004 Renn et al.
6,855,631 B2 2/2005 Kirby
6,890,624 B1 5/2005 Kambe et al.
6,921,626 B2 7/2005 Ray et al.
6,998,345 B2 2/2006 Kirby
6,998,785 B1 2/2006 Silfvast et al.
7,009,137 B2 3/2006 Guo et al.
7,045,015 B2 5/2006 Renn et al.
7,108,894 B2 9/2006 Renn
7,164,818 B2 1/2007 Bryan et al.
7,171,093 B2 1/2007 Kringlebotn et al.
7,178,380 B2 2/2007 Shekarriz et al.
7,270,844 B2 9/2007 Renn
7,294,366 B2 11/2007 Renn et al.
7,402,897 B2 7/2008 Leedy
7,469,558 B2 12/2008 Demaray et al.
7,485,345 B2 2/2009 Renn et al.
7,658,163 B2 2/2010 Renn et al.
7,674,671 B2 3/2010 Renn et al.
7,836,922 B2 11/2010 Poole et al.
7,938,079 B2 5/2011 King et al.
7,987,813 B2 8/2011 Renn et al.
8,012,235 B2 9/2011 Takashima et al.
8,383,014 B2 2/2013 Vandeusden et al.
8,796,146 B2 8/2014 Renn et al.
8,887,658 B2 * 11/2014 Essien ..... B05B 7/0075 118/300
8,916,084 B2 12/2014 Chretien et al.
8,919,899 B2 12/2014 Essien
9,694,389 B2 7/2017 Fan et al.
10,058,881 B1 * 8/2018 Keicher ..... B05B 1/3026
2001/0027011 A1 10/2001 Hanaoka et al.
2001/0046551 A1 11/2001 Falck et al.
2002/0012743 A1 1/2002 Sampath et al.
2002/0012752 A1 1/2002 McDougall et al.
2002/0063117 A1 5/2002 Church et al.
2002/0071934 A1 6/2002 Marutsuka
2002/0082741 A1 6/2002 Mazumder et al.
2002/0096647 A1 7/2002 Moors et al.
2002/0100416 A1 * 8/2002 Sun ..... B05B 7/0012 118/693
2002/0107140 A1 8/2002 Hampden-Smith et al.
2002/0128714 A1 9/2002 Manasas et al.
2002/0132051 A1 9/2002 Choy
2002/0145213 A1 10/2002 Liu et al.
2002/0162974 A1 11/2002 Orsini et al.
2003/0003241 A1 1/2003 Suzuki et al.
2003/0020768 A1 1/2003 Renn
2003/0032214 A1 2/2003 Huang
2003/0048314 A1 3/2003 Renn
2003/0108511 A1 6/2003 Sawhney
2003/0108664 A1 6/2003 Kodas et al.
2003/0117691 A1 6/2003 Bi et al.
2003/0138967 A1 7/2003 Hall et al.
2003/0149505 A1 8/2003 Mogensen
2003/0175411 A1 9/2003 Kodas et al.
2003/0180451 A1 9/2003 Kodas et al.
2003/0202043 A1 10/2003 Moffat et al.
2003/0219923 A1 11/2003 Nathan et al.
2003/0228124 A1 12/2003 Renn et al.
2004/0004209 A1 1/2004 Matsuba et al.
2004/0029706 A1 2/2004 Barrera et al.
2004/0038808 A1 2/2004 Hampden-Smith et al.
2004/0080917 A1 4/2004 Steddom et al.
2004/0151978 A1 8/2004 Huang
2004/0179808 A1 9/2004 Renn
2004/0185388 A1 9/2004 Hirai
2004/0191695 A1 9/2004 Ray et al.
2004/0197493 A1 10/2004 Renn et al.
2004/0227227 A1 11/2004 Imanaka et al.
2004/0247782 A1 12/2004 Hampden-Smith et al.
2005/0002818 A1 1/2005 Ichikawa
2005/0003658 A1 1/2005 Kirby
2005/0046664 A1 3/2005 Renn
2005/0097987 A1 5/2005 Kodas et al.

(56) References Cited

U.S. PATENT DOCUMENTS

| | | | |
|---|---|---|---|
| 2005/0101129 | A1 | 5/2005 | Lirby |
| 2005/0110064 | A1 | 5/2005 | Duan et al. |
| 2005/0129383 | A1 | 6/2005 | Renn et al. |
| 2005/0133527 | A1 | 6/2005 | Dullea et al. |
| 2005/0145968 | A1 | 7/2005 | Goela et al. |
| 2005/0147749 | A1 | 7/2005 | Liu et al. |
| 2005/0156991 | A1 | 7/2005 | Renn |
| 2005/0163917 | A1 | 7/2005 | Renn |
| 2005/0171237 | A1 | 8/2005 | Patel et al. |
| 2005/0184328 | A1 | 8/2005 | Uchiyama et al. |
| 2005/0205415 | A1 | 9/2005 | Belousov et al. |
| 2005/0205696 | A1 | 9/2005 | Saito et al. |
| 2005/0214480 | A1 | 9/2005 | Garbar et al. |
| 2005/0215689 | A1 | 9/2005 | Garbar et al. |
| 2005/0238804 | A1 | 10/2005 | Garbar et al. |
| 2005/0247681 | A1 | 11/2005 | Boillot et al. |
| 2005/0275143 | A1 | 12/2005 | Toth |
| 2006/0003095 | A1 | 1/2006 | Bullen et al. |
| 2006/0008590 | A1 | 1/2006 | King et al. |
| 2006/0035033 | A1 | 2/2006 | Tanahashi |
| 2006/0043598 | A1 | 3/2006 | Kirby et al. |
| 2006/0046347 | A1 | 3/2006 | Wood et al. |
| 2006/0046461 | A1 | 3/2006 | Benson et al. |
| 2006/0057014 | A1 | 3/2006 | Oda et al. |
| 2006/0116000 | A1 | 6/2006 | Yamamoto |
| 2006/0159899 | A1 | 7/2006 | Edwards et al. |
| 2006/0162424 | A1 | 7/2006 | Shekarriz et al. |
| 2006/0163570 | A1 | 7/2006 | Renn et al. |
| 2006/0163744 | A1 | 7/2006 | Vanheusden et al. |
| 2006/0172073 | A1 | 8/2006 | Groza et al. |
| 2006/0175431 | A1 | 8/2006 | Renn et al. |
| 2006/0189113 | A1 | 8/2006 | Vanheusden et al. |
| 2006/0233953 | A1 | 10/2006 | Renn et al. |
| 2006/0280866 | A1 | 12/2006 | Marquez et al. |
| 2007/0019028 | A1 | 1/2007 | Renn et al. |
| 2007/0128905 | A1 | 6/2007 | Speakman |
| 2007/0154634 | A1 | 7/2007 | Renn |
| 2007/0181060 | A1 | 8/2007 | Renn et al. |
| 2007/0227536 | A1* | 10/2007 | Rivera ..... B05B 7/0012 128/200.21 |
| 2007/0240454 | A1 | 10/2007 | Brown |
| 2008/0013299 | A1 | 1/2008 | Renn |
| 2008/0099456 | A1 | 5/2008 | Schwenke et al. |
| 2009/0039249 | A1 | 2/2009 | Wang et al. |
| 2009/0061077 | A1 | 3/2009 | King et al. |
| 2009/0061089 | A1 | 3/2009 | King et al. |
| 2009/0090298 | A1 | 4/2009 | King et al. |
| 2009/0114151 | A1 | 5/2009 | Renn et al. |
| 2009/0229412 | A1 | 9/2009 | Takashima et al. |
| 2009/0252874 | A1 | 10/2009 | Essien |
| 2010/0112234 | A1 | 6/2010 | Spatz et al. |
| 2010/0140811 | A1 | 6/2010 | Leal et al. |
| 2010/0173088 | A1 | 7/2010 | King |
| 2010/0192847 | A1 | 8/2010 | Renn et al. |
| 2010/0255209 | A1 | 10/2010 | Renn et al. |
| 2011/0129615 | A1 | 6/2011 | Renn et al. |
| 2012/0038716 | A1 | 2/2012 | Hoerteis et al. |
| 2012/0177319 | A1 | 7/2012 | Alemohammad et al. |
| 2013/0029032 | A1 | 1/2013 | King et al. |
| 2013/0260056 | A1 | 10/2013 | Renn et al. |
| 2013/0283700 | A1 | 10/2013 | Bajaj et al. |
| 2014/0035975 | A1 | 2/2014 | Essien et al. |
| 2014/0342082 | A1 | 11/2014 | Renn |
| 2015/0217517 | A1 | 8/2015 | Karpas |
| 2016/0172741 | A1 | 6/2016 | Panat et al. |
| 2016/0193627 | A1 | 7/2016 | Essien |
| 2016/0229119 | A1 | 8/2016 | Renn |
| 2016/0242296 | A1 | 8/2016 | Deangelis |
| 2017/0348903 | A1 | 12/2017 | Renn et al. |
| 2018/0015730 | A1 | 1/2018 | Essien et al. |

FOREIGN PATENT DOCUMENTS

| | | | |
|---|---|---|---|
| CN | 101111129 | | 1/2008 |
| DE | 1984101 | | 4/2000 |
| EP | 0331022 | A2 | 9/1989 |
| EP | 0444550 | A2 | 9/1991 |
| EP | 0470911 | | 7/1994 |
| EP | 1258293 | | 11/2002 |
| EP | 1452326 | | 9/2004 |
| EP | 1670610 | | 6/2006 |
| GB | 2322735 | | 9/1998 |
| JP | 05318748 | | 12/1993 |
| JP | 8156106 | | 6/1996 |
| JP | 2001507449 | | 6/2001 |
| JP | 2002539924 | | 11/2002 |
| JP | 3425522 | | 7/2003 |
| JP | 2004122341 | | 4/2004 |
| JP | 2006051413 | | 2/2006 |
| JP | 2007507114 | | 3/2007 |
| KR | 20000013770 | | 3/2000 |
| KR | 1002846070000 | | 8/2001 |
| KR | 1020070008614 | | 1/2007 |
| KR | 1020070008621 | | 1/2007 |
| KR | 1020070019651 | | 2/2007 |
| TW | 200636091 | | 10/2006 |
| WO | 9218323 | | 10/1992 |
| WO | 9633797 | | 10/1996 |
| WO | 9738810 | | 10/1997 |
| WO | 0023825 | | 4/2000 |
| WO | 0069235 | | 11/2000 |
| WO | 0183101 | A1 | 11/2001 |
| WO | 2005075132 | A1 | 8/2005 |
| WO | 2006041657 | A2 | 4/2006 |
| WO | 2006065978 | | 6/2006 |
| WO | WO-2006065978 | A2 * | 6/2006 ..... C23C 18/06 |
| WO | 2006076603 | | 7/2006 |
| WO | 2013010108 | | 1/2013 |
| WO | 2013162856 | | 10/2013 |

OTHER PUBLICATIONS

Ashkin, A , "Acceleration and Trapping of Particles by Radiation Pressure", Physical Review Letters, Jan. 26, 1970, 156-159.

Ashkin, A. , "Optical trapping and manipulation of single cells using infrared laser beams", Nature, Dec. 1987, 769-771.

Dykhuizen, R. C., "Impact of High Velocity Cold Spray Particles", May 13, 2000, 1-18.

Fernandez De La Mora, J. , et al., "Aerodynamic focusing of particles in a carrier gas", J. Fluid Mech., 1988, 1-21.

Gladman, A. Sydney, et al., "Biomimetic 4D printing", Nature Materials, vol. 15, Macmillan Publishers Limited, Jan. 25, 2016, 413-418.

Harris, Daniel J., et al., "Marangoni Effects on Evaporative Lithographic Patterning of Colloidal Films", Langmuir, Vo. 24, No. 8, American Chemical Society, Mar. 4, 2008, 3681-3685.

King, Bruce , et al., "M3D TM Technology: Maskless Mesoscale TM Materials Deposition", Optomec pamphlet, 2001.

Krassenstein, Brian , "Carbon3D Unveils Breakthrough CLIP 3D Printing Technology, 25-100X Faster", http://3dprint.com/51566/carbon3d-clip-3d-printing, Mar. 16, 2015.

Lewandowski, H. J., et al., "Laser Guiding of Microscopic Particles in Hollow Optical Fibers", Announcer 27, Summer Meeting—Invited and Contributed Abstracts, Jul. 1997, 89.

Lewis, Jennifer A., "Novel Inks for Direct-Write Assembly of 3-D Periodic Structures", Material Matters, vol. 3, No. 1, Aldrich Chemistry Company, 2008, 4-9.

Marple, V. A., et al., "Inertial, Gravitational, Centrifugal, and Thermal Collection Techniques", Aerosol Measurement: Principles, Techniques and Applications, 2001, 229-260.

Miller, Doyle , et al., "Maskless Mesoscale Materials Deposition", HDI, Sep. 2001, 1-3.

Nanodimension , "The DragonFly 2020 3D Printer", http://www.nano-di.com/3d-printer, 2015.

Nordson , "Fluid Dispensing Systems and Equipment", http://www.nordson.com/en/divisions/asymtek/products/fluid-dispensing-systems?nor_division_facet_b=f65ab511444f4ce087bae3fb19491a82, 2015.

(56) References Cited

OTHER PUBLICATIONS

Nscrypt , "3D Printing", http://nscrypt.com/3d-printing, 2015.
Nscrypt , "3DN HP Series", http://www.nscrypt.com/3d-printing, 2015.
Nscrypt , "3DN Series", http://www.nscrypt.com/3d-printing, 2015.
Nscrypt , "nFD Specification Sheet", http://www.nscrypt.com/3d-printing, 2015.
Nscrypt , "SmartPump 100 Specification Sheet", http://www.nscrypt.com/3d-printing, 2015.
Odde, D. J., et al., "Laser-Based Guidance of Cells Through Hollow Optical Fibers", The American Society for Cell Biology Thirty-Seventh Annual Meeting, Dec. 17, 1997.
Odde, D. J., et al., "Laser-guided direct writing for applications in biotechnology", Trends in Biotechnology, Oct. 1999, 385-389.
O'Reilly, Mike , et al., "Jetting Your Way to Fine-pitch 3D Interconnects", Chip Scale Review, Sep./Oct. 2010, 18-21.
Rao, N. P., et al., "Aerodynamic Focusing of Particles in Viscous Jets", J. Aerosol Sci., 1993, 879-892.
Renn, M. J., et al., "Evanescent-wave guiding of atoms in hollow optical fibers", Physical Review A, Feb. 1996, R648-R651.
Renn, Michael J., et al., "Flow- and Laser-Guided Direct Write of Electronic and Biological Components", Direct-Write Technologies for Rapid Prototyping Applications, 2002, 475-492.
Renn, M. J., et al., "Laser-Guidance and Trapping of Mesoscale Particles in Hollow-Core Optical Fibers", Physical Review Letters, Feb. 15, 1999, 1574-1577.
Renn, M. J., et al., "Laser-Guided Atoms in Hollow-Core Optical Fibers", Physical Review Letters, Oct. 30, 1995, 3253-3256.
Renn, M. J., et al., "Optical-dipole-force fiber guiding and heating of atoms", Physical Review A, May 1997, 3684-3696.
Renn, M. J., et al., "Particle Manipulation and Surface Patterning by Laser Guidance", Submitted to EIPBN '98, Session AM4, 1998.
Renn, M. J., et al., "Particle manipulation and surface patterning by laser guidance", Journal of Vacuum Science & Technology B, Nov./Dec. 1998, 3859-3863.
Sammarco, Carmine , et al., "Metals Having Improved Microstructure and Method of Making", U.S. Provisional Patent Application filed in U.S. Patent Office, May 15, 2001.
Smugeresky, J. E., et al., "Laser Engineered Net Shaping (LENS TM) Process: Optimization of Surface Finish and Microstructural Properties", Jun. 30, 1997, 1-11.
Smugeresky, J. E., et al., "Using the Laser Engineered Net Shaping (LENS TM) Process to Produce Complex Components from a CAD Solid Model", Proceedings of the SPIE—The International Society for Optical Engineering, Lasers as Tools for Manufacturing, II, Feb. 12-17, 1997, 3-9.
Sobeck , et al., "Technical Digest: 1994 Solid-State Sensor and Actuator Workshop", 1994, 647.
Stratasys , "FDM Technology", http://www.stratasys.com/3d-printers/technologies/fdm-technology, 2015.
Stratasys , "PolyJet Technology", http://www.stratasys.com/3d-printers/technologies/polyjet-technology, 2015.
TSI Incorporated , "How a Virtual Impactor Works", www.tsi.com, Sep. 21, 2001.
Vanheusden, Karel , et al., "Direct Printing of Interconnect Materials for Organic Electronics", IMAPS ATW Printing for an Intelligent Future, Mar. 8-10, 2002, 1-5.
Wikipedia , "Continuous Liquid Interface Production", https://www.en.wikipedia.org/wiki/Continuous_Liquid_Interface_Production, Sep. 29, 2015.
Wikipedia , "Selective laser sintering", https://en.wikipedia.org/wiki/Selective_laser_sintering, Nov. 23, 2015.
Wikipedia , "Stereolithography", https://en/wikipedia/org/wiki/Stereolithography, Feb. 4, 2016.
Zhang, Xuefeng , et al., "A Numerical Characterization of Particle Beam Collimation by an Aerodynamic Lens-Nozzle System: Part I. An Individual Lens or Nozzle", Aerosol Science and Technology, 2002, 617-631.

* cited by examiner

SHUTTERING OF AEROSOL STREAMS

CROSS-REFERENCE TO RELATED APPLICATIONS

This application is a divisional application of U.S. patent application Ser. No. 16/190,007, entitled "Shuttering of Aerosol Streams", filed on Nov. 13, 2018, which application claims priority to and the benefit of the filing of U.S. Provisional Patent Application No. 62/585,449, entitled "Internal Shuttering", filed on Nov. 13, 2017. The specification and claims thereof are incorporated herein by reference.

BACKGROUND OF THE INVENTION

Field of the Invention (Technical Field)

The present invention relates to apparatuses and methods for pneumatic shuttering of an aerosol stream. The aerosol stream can be a droplet stream, a solid particle stream, or a stream composed of droplets and solid particles.

Description of Related Art

Note that the following discussion may refer to a number of publications and references. Discussion of such publications herein is given for more complete background of the scientific principles and is not to be construed as an admission that such publications are prior art for patentability determination purposes.

Typical apparatuses for shuttering or diverting aerosol flows in aerosol jet printing use a shuttering mechanism that is downstream of the aerosol deposition nozzle, and typically require an increased working distance from the deposition orifice to the substrate to accommodate the mechanism. An increased working distance can lead to deposition at a non-optimal nozzle-to-substrate distance where the focus of the aerosol jet is degraded. External shuttering mechanisms can also interfere mechanically when printing inside of cavities or when upward protrusions exist on an otherwise substantially flat surface, such as a printed circuit board including mounted components. In contrast, internal shuttering occurs in the interior of the print head, upstream of the orifice of the deposition nozzle, and allows for a minimal nozzle-to-substrate distance, which is often needed for optimal focusing or collimation of the aerosol stream.

In aerosol jet printing, internal and external aerosol stream shuttering can be achieved using a mechanical impact shutter which places a solid blade or spoon-like shutter in the aerosol stream, so that particles maintain the original flow direction, but impact on the shutter surface. Impact shutters typically use an electromechanical configuration wherein a voltage pulse is applied to a solenoid that moves the shutter into the path of the aerosol stream. Impact based shuttering can cause defocusing of the particle stream as the shutter passes through the aerosol stream. Impact shutters can also cause extraneous material deposition or fouling of the flow system as excess material accumulates on the shutter surface and is later dislodged. Impact based shuttering schemes can have shutter on/off times as small as 2 ms or less. Aerosol stream shuttering can alternatively use a pneumatic shutter to divert the aerosol stream from the original flow direction and into a collection chamber or to an exhaust port. Pneumatic shuttering is a non-impact process, so there is no shuttering surface on which ink can accumulate. Minimizing ink accumulation during printing, diverting (shuttering), and particularly during the transitions between printing and diverting is a critical aspect of pneumatic shutter design. Non-impact shuttering schemes can have shutter on/off times below 10 ms for fast-moving aerosol streams.

A drawback to pneumatic shuttering is that the transition between on and off can take longer than that for mechanical shuttering. Existing pneumatic shuttering schemes require long switching times due to the time required for the aerosol stream to propagate downward through the lower portion of the flow cell when resuming printing after shuttering, or the time required for clean gas from the shutter to propagate down when shuttering is initiated. Furthermore, the turn-off and turn-on of the aerosol is not abrupt, but instead has a significant transition time. When gas propagates through a cylindrical channel under laminar (non-turbulent) conditions the center of the flow along the axis of the channel moves at twice the average flow speed and the flow along the walls has near zero velocity. This results in a parabolic flow distribution where full aerosol flow to the substrate, which includes aerosol near the channel wall, lags significantly behind the initial flow. Likewise, when shuttering, the final turn-off when the slow-moving mist near the wall reaches the substrate is substantially delayed from when the fast-moving aerosol from the center of the flow is replaced with clean gas. This effect increases greatly the "fully-shuttered" time compared to the initial shuttering time. Thus there is a need for an internal pneumatic aerosol flow shuttering system that minimizes switching and shuttering transition times.

BRIEF SUMMARY OF THE INVENTION

An embodiment of the present invention is a method for controlling the flow of an aerosol in a print head of an aerosol deposition system, the method comprising passing an aerosol flow through the print head in an original aerosol flow direction; surrounding the aerosol flow with a sheath gas; passing the combined aerosol flow and the sheath gas through a deposition nozzle of the print head; adding a boost gas to the sheath gas to form a sheath-boost gas flow; dividing the sheath-boost gas flow into a first portion flowing in a direction opposite to the original aerosol flow direction and a second portion flowing in the original aerosol flow direction; and the first portion of the sheath-boost gas flow preventing a deflected portion of the aerosol flow from passing through the deposition nozzle. The flow rate of the sheath gas and a flow rate of the aerosol flow preferably remain approximately constant. Prior to adding the boost gas to the sheath gas the boost gas preferably flows to a vacuum pump. The method preferably further comprises extracting an exhaust flow from the print head after the increasing step, the exhaust flow comprising the deflected portion of the aerosol flow and the first portion of the sheath-boost gas flow. Extracting the exhaust flow preferably comprises suctioning the exhaust flow using the vacuum pump. The flow rate of the exhaust flow is preferably controlled by a mass flow controller. The flow rate of the sheath gas and the flow rate of the boost gas are preferably controlled by one or more flow controllers. The flow rate of the aerosol flow prior to the adding step plus the flow rate of sheath gas prior to the adding step preferably approximately equals a flow rate of the second portion of the sheath-boost gas flow plus a flow rate of the undeflected portion of the aerosol flow. The method can preferably be performed in less than approximately 10 milliseconds. The flow rate of the boost gas is optionally greater than the flow rate of the aerosol flow, and more preferably is between approximately 1.2 times the flow rate of the aerosol flow and approximately 2 times the flow rate of the aerosol flow. The deflected portion of the aerosol flow optionally comprises the entire aerosol flow so that none of the aerosol flow passes through the deposition nozzle. The flow rate of the exhaust flow is optionally set to approximately equal the flow rate of the boost gas. The method optionally further comprises diverting the boost gas to flow directly to the vacuum pump prior to all of the undeflected portion of the aerosol flow exiting the print head through the deposition nozzle. The method optionally comprises blocking a flow of the aerosol with a mechanical shutter prior to the preventing step. The flow rate of the boost gas can alternatively be less than or equal to the flow rate of the aerosol flow, in which case the flow rate of the exhaust flow is preferably set to be greater than the flow rate of the boost gas. The method preferably further comprises surrounding the aerosol with a pre-sheath gas prior to surrounding the aerosol flow with the sheath gas, preferably thereby combining the sheath gas with the pre-sheath gas. Preferably approximately half of the sheath gas is used to form the pre-sheath gas.

Another embodiment of the present invention is an apparatus for depositing an aerosol, the apparatus comprising an aerosol supply; a sheath gas supply; a boost gas supply; a vacuum pump; a valve for connecting the boost gas supply to the sheath gas supply or the vacuum pump; and a print head, the print head comprising an aerosol inlet for receiving an aerosol from the aerosol supply; a first chamber comprising a sheath gas inlet for receiving a sheath gas from the sheath gas supply; the second chamber configured to surround the aerosol with the sheath gas; and a second chamber comprising an exhaust gas outlet connected to the vacuum pump, the second chamber disposed between the aerosol inlet and the first chamber; and a deposition nozzle; wherein the sheath gas inlet receives a combination of a boost gas from the boost gas supply and the sheath gas when the boost gas supply is connected to the sheath gas supply; and wherein the first chamber is configured to divide a portion of the combination into a first portion flowing toward the aerosol inlet and a second portion flowing toward the deposition nozzle. The apparatus preferably comprises a first mass flow controller disposed between the exhaust gas outlet and the vacuum pump and preferably comprises a filter disposed between the exhaust gas outlet and the first mass flow controller. The apparatus preferably comprises a second mass flow controller disposed between the sheath gas supply and the sheath gas inlet and a third mass flow controller disposed between the boost gas supply and the valve. The flow of gas entering the sheath gas inlet is preferably in a direction perpendicular to an aerosol flow direction in the print head. The apparatus optionally comprises a mechanical shutter. The apparatus preferably comprises a third chamber disposed between the aerosol inlet and the second chamber, the third chamber preferably comprising a pre-sheath gas inlet and preferably configured to surround the aerosol with a pre-sheath gas. A flow divider is preferably connected between the pre-sheath gas inlet and the sheath gas supply for forming the pre-sheath gas from approximately one-half of the sheath gas.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate the practice of embodiments of the present invention and, together with the description, serve to explain the principles of the invention. The drawings are only for the purpose of illustrating certain embodiments of the invention and are not to be construed as limiting the invention. In the figures.

DETAILED DESCRIPTION OF THE INVENTION

Figure 1:
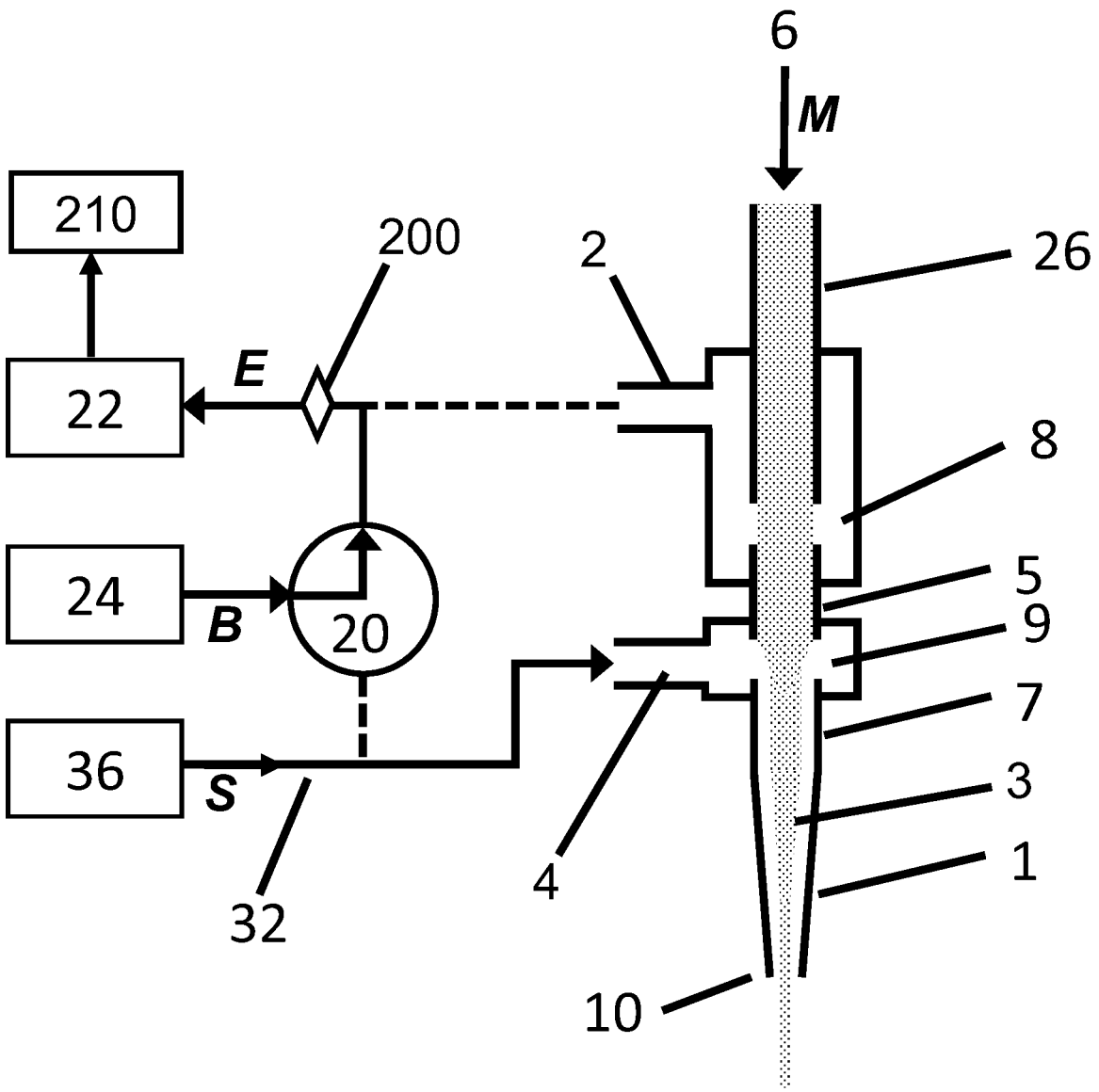
FIG. 1 is a schematic of an embodiment of a print head incorporating an internal pneumatic shuttering system of the present invention showing flows and aerosol distribution in the print configuration.

Embodiments of the present invention are apparatuses and methods for rapid shuttering of an aerosol stream or a sheathed aerosol stream, which can be applied to, but are not limited to, processes requiring coordinated shuttering of a fluid, such as for aerosol-based printing of discrete structures for directly written electronics, for aerosol delivery applications, or for various three-dimensional printing applications. The fluid stream may comprise solid particles in liquid suspension, liquid droplets, or a combination thereof. As used herein, the terms "droplet" or "particle", used interchangeably, mean liquid droplets, liquids with solid particles in suspension, or mixtures thereof. The present invention provides methods and apparatuses to enable controlled full or partial on-and-off deposition of ink droplets in an aerosol stream for printing arbitrary patterns on a surface with Aerosol Jet® technology.

In one or more embodiments of the present invention, an internal shutter is incorporated into an apparatus for high-resolution, maskless deposition of liquid ink using aerodynamic focusing. This apparatus typically comprises an atomizer for generating a mist by atomizing the liquid into fine microdroplets. The atomized mist is then transported by a carrier gas flow to a deposition nozzle for directing and focusing the aerosol mist stream. The apparatus also preferably comprises a control module for automated control of process parameters and a motion control module that drives relative motions of the substrate with respect to the deposition nozzle. Aerosolization of liquid inks can be accomplished with a number of methods, including using an ultrasonic atomizer or pneumatic atomizer. The aerosol stream is focused using the Aerosol Jet® deposition nozzle with a converging channel and an annular, co-flowing sheath gas which wraps the aerosol stream to protect the channel wall from direct contact with liquid ink droplets and to focus the aerosol stream into smaller diameter when accelerated through the converging nozzle channel. The aerosol stream surrounded by the sheath gas exits the deposition nozzle and impacts the substrate. The high-speed jet flow of the collimated aerosol stream with sheath gas enables high-precision material deposition with an extended standoff distance for direct-write printing. The Aerosol Jet® deposition head is capable of focusing an aerosol stream to as small as one-tenth the size of the nozzle orifice. Ink patterning can be accomplished by attaching the substrate to a platen with computer-controlled motion while the deposition nozzle is fixed. Alternatively, the deposition head can move under computer control while the substrate position remains fixed, or both the deposition head and substrate can move relatively under computer control. The aerosolized liquid used in the Aerosol Jet process consists of any liquid ink material including, but not limited to, liquid molecular precursors for a particular material, particulate suspensions, or some combination of precursor and particulates. Fine lines of width less than 10 μm have been printed using the Aerosol Jet® system and the internal pneumatic shutter apparatus of the present invention.

A print head comprising an embodiment of the internal shuttering of the present invention is shown in FIG. 1. The print head comprises internal mist switching chamber 8. Aerosol stream 6 generated by an atomizer preferably enters through the top of the print head and moves in the direction indicated by the arrow. The mist flow rate M preferably remains steady during both printing and diverting of aerosol stream 6. During printing aerosol stream 6 preferably enters the print head from the top and travels through upper mist tube 26 to mist switching chamber 8, and then through the middle mist tube 5 to sheath-boost chamber 9, where aerosol stream 6 is surrounded by sheath gas flow 32 from the sheath mass flow controller 36, through the lower mist tube 7 to the deposition nozzle 1 and exits the nozzle tip 10. Sheath gas flow 32 with flow rate S, which is preferably delivered from a gas supply such as a compressed air cylinder and controlled via mass flow controller 36, is preferably introduced into the print head through sheath-boost inlet 4 to form a preferably axisymmetric, annular, co-flowing sheath wrapping around the aerosol stream in sheath-boost chamber 9, thus protecting the walls of lower mist tube 7 and deposition nozzle 1 from impaction by droplets of the aerosol. The sheath gas also serves to focus the aerosol stream, enabling deposition of small diameter features. During printing, three-way valve 20 is configured so that boost gas flow 44 from boost mass flow controller 24 does not enter sheath-boost chamber 9, but instead bypasses the print head and exits the system through exhaust mass flow controller 22.

Figure 2:
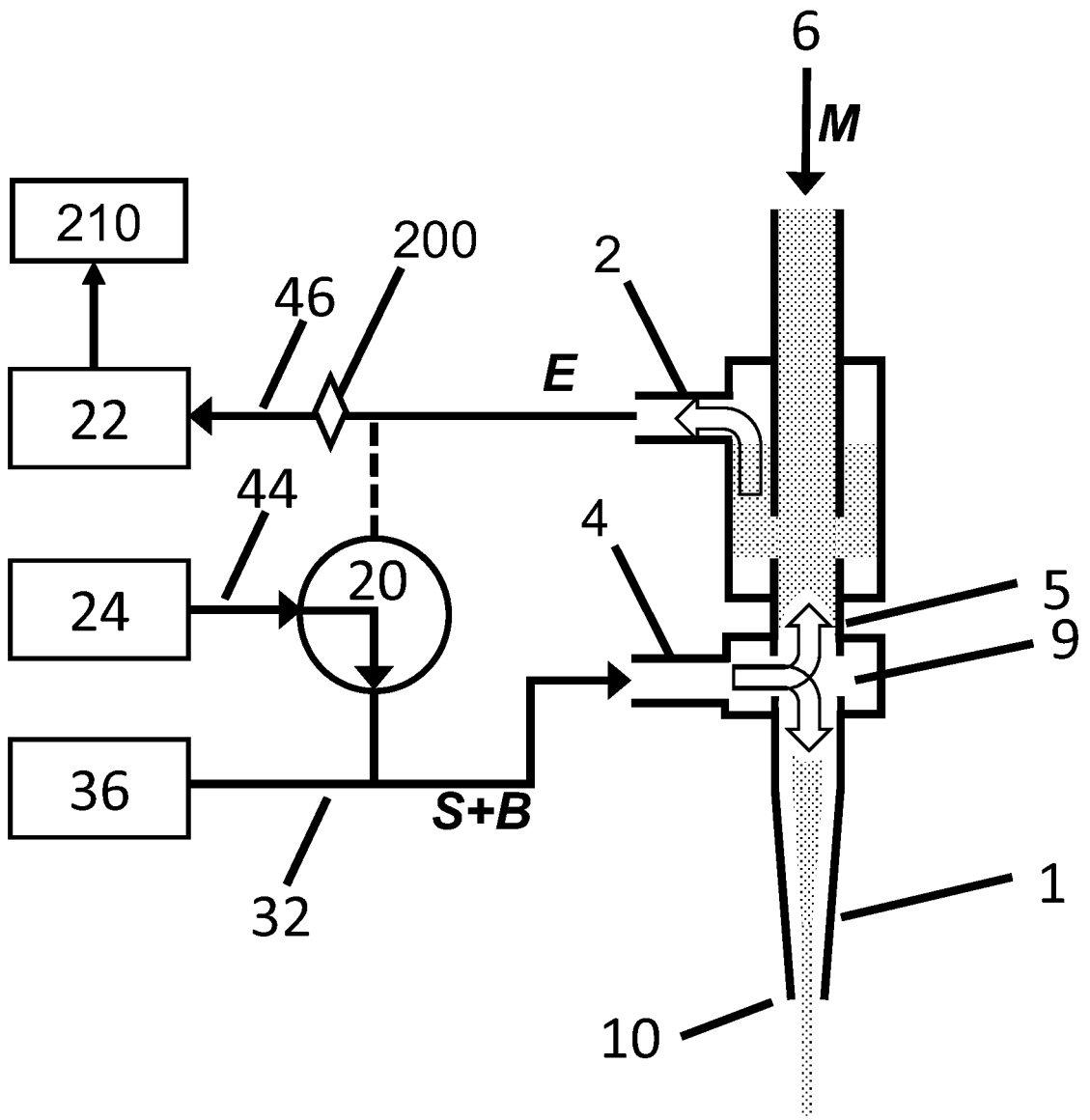
FIG. 2 is a schematic of the flows and aerosol distribution in the device of FIG. 1 when the device is initially switched to the divert configuration.

As shown in FIG. 2, to accomplish shuttering or diversion of the aerosol flow, three-way valve 20 switches such that boost gas flow 44 having a flow velocity B, which is preferably supplied by a gas supply such as a compressed air cylinder and controlled by mass flow controller 24, combines with sheath gas flow 32 and enters the print head through sheath-boost inlet 4. Exhaust flow 46 exits the print head through the exhaust outlet 2 and diverts the aerosol stream 6 away from middle mist tube 5. When the combined sheath gas flow 32 and boost gas flow 44 enter sheath-boost chamber 9 through sheath-boost inlet 4, they are split into equal or unequal flows in both the upwards (i.e. in a direction opposite to the flow direction of aerosol stream 6) and downwards directions. When a portion of the combined sheath and boost gas flows travels downward towards nozzle tip 10, it propels the aerosol particles between sheath-boost chamber 9 and deposition nozzle tip 10 out through nozzle tip 10.

Figure 3:
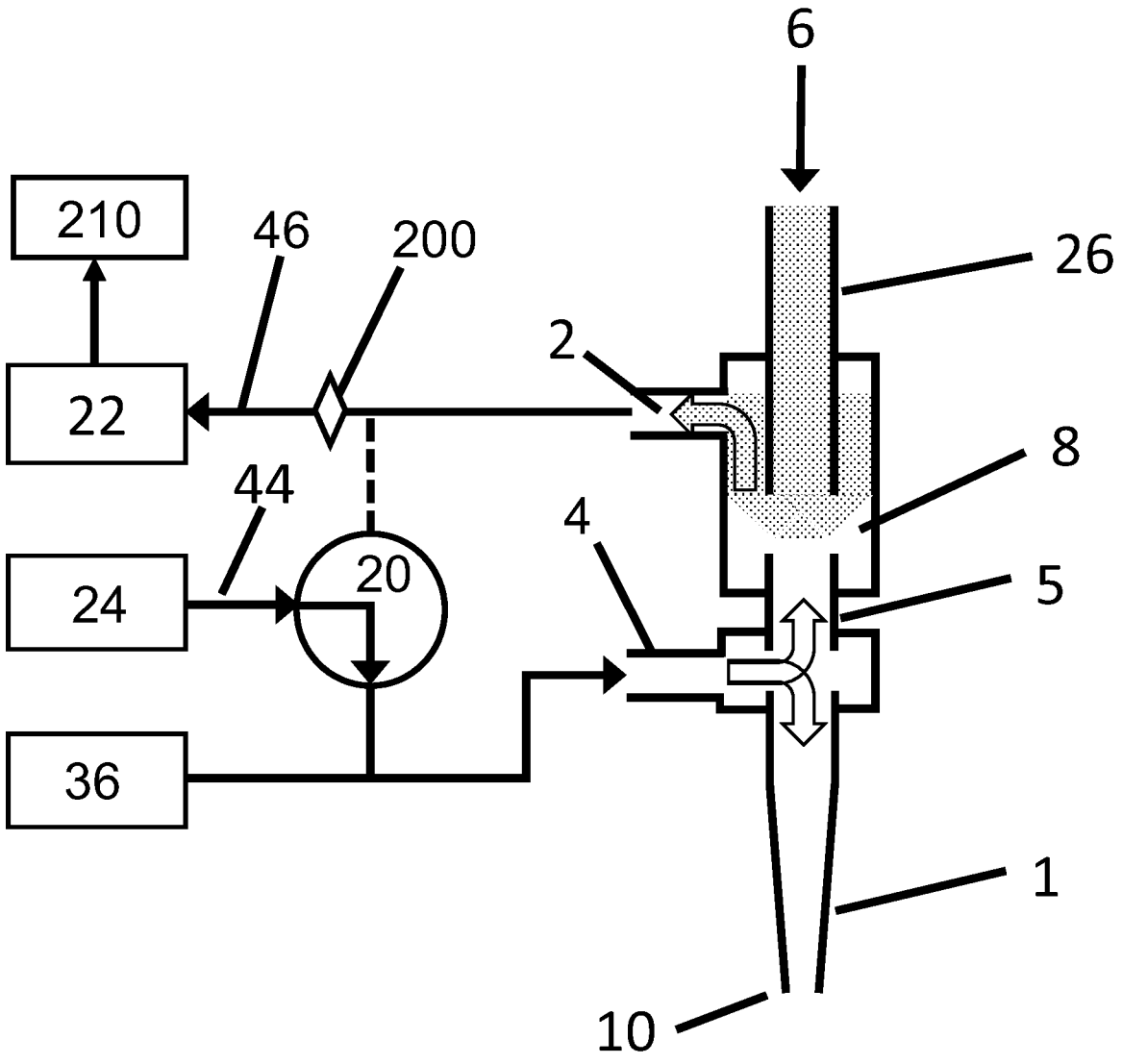
FIG. 3 is a schematic of the flows and aerosol distribution in the device of FIG. 1 in the divert configuration when all aerosol flow through the print nozzle has been stopped.

After the residual aerosol is cleared from the nozzle tip 10, which can take approximately 5-50 milliseconds (depending on the gas flow rates), the printing shuts off, as shown in FIG. 3. While the aerosol stream in the deposition nozzle 1 is being cleared, the upwards portion of the combined boost and sheath gas flow pushes the residual aerosol stream 6 in middle mist tube 5 up towards exhaust outlet 2. Aerosol stream 6 continues to exit upper mist tube 26 but is diverted out exhaust outlet 2. The net outward exhaust flow from exhaust outlet 2, having flow rate E, is preferably driven by vacuum pump 210, preferably operated at approximately seven pounds vacuum, and controlled by exhaust mass flow controller 22. As used throughout the specification and claims, the term "vacuum pump" means a vacuum pump or any other suction producing apparatus. Because flow rate control devices typically contain valves with small orifices or small channels which can be contaminated or even damaged if the ink-laden exhaust flow passes through them, mist particle filter or other filtration mechanism 200 is preferably implemented between exhaust outlet 2 and exhaust mass flow controller 22.

Figure 4:
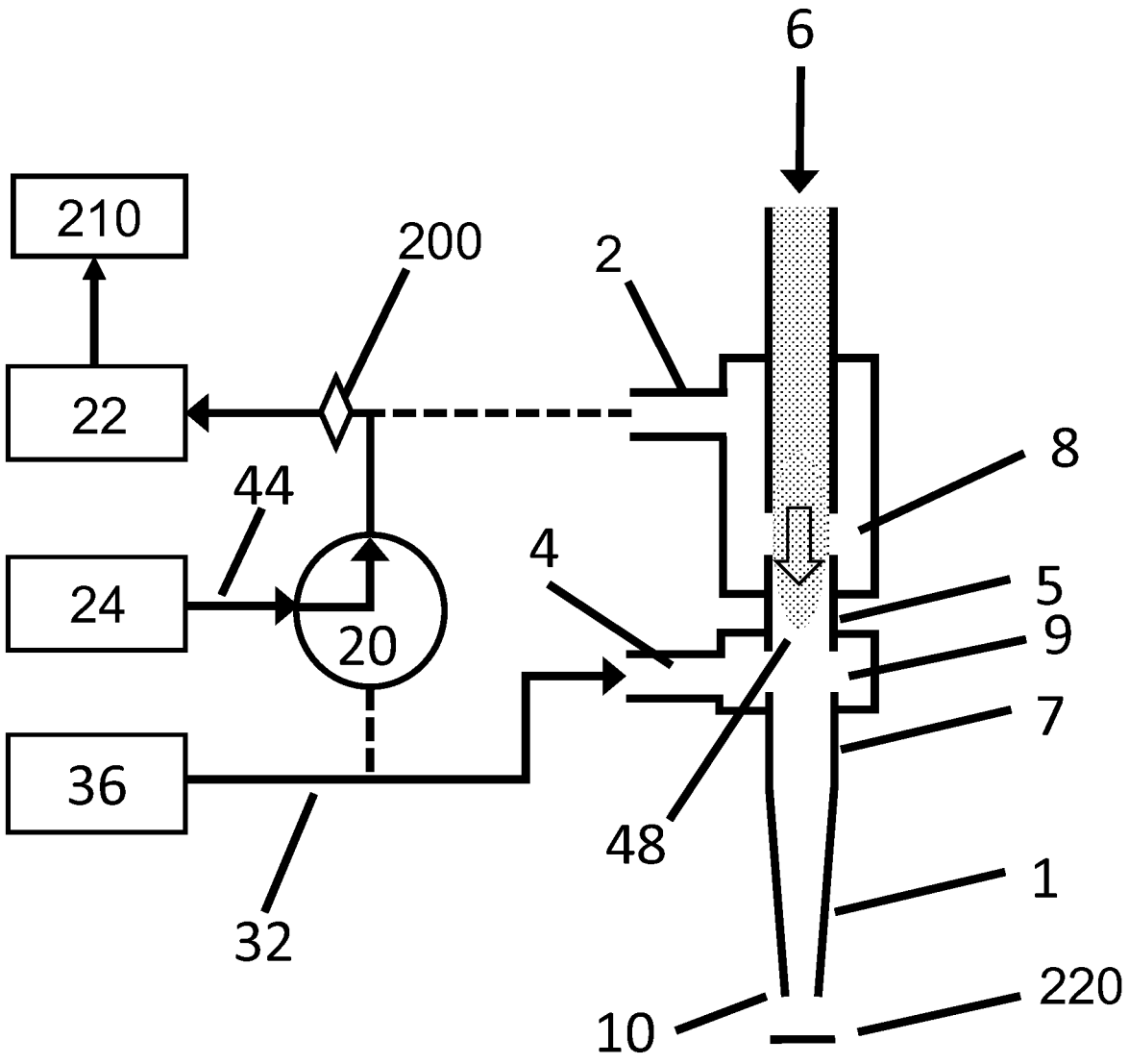
FIG. 4 is a schematic of the flows and aerosol distribution in the device of FIG. 1 when the print configuration has been resumed.

When the print configuration is resumed, as shown in FIG. 4, the boost gas and exhaust flows do not pass thru the head, and no upwards flow occurs in middle mist tube 5. In the printing configuration, three-way valve 20 is switched such that boost gas flow 44 bypasses the print head. Sheath mass flow controller 36 continues to supply sheath gas flow 32 to sheath-boost inlet 4. The leading edge of aerosol stream 6 resumes a substantially parabolic flow profile 48 down the print head through mist switching chamber 8, first filling middle mist tube 5, and is then surrounded by sheath gas flow 32, after which the co-flowing aerosol stream 6 and sheath gas flows into the deposition nozzle 1 and finally through the nozzle tip 10. When switching from diverting to printing, aerosol stream 6 passes downward through middle mist tube 5, sheath-boost chamber 9, and deposition nozzle 1 before printing will resume. Small lengths and inner diameters for middle mist tube 5 and lower mist tube 7 are preferable to minimize on/off delays. Switching from diverting to printing functions can occur in as little as 10 milliseconds. Switching from printing to diverting can occur in as little as 5 milliseconds, depending on the nozzle or orifice size, boost flow rate, and sheath flow rate.

Mist switching chamber 8 is preferably located as close to nozzle tip 10 as possible to minimize mist flow response time that correlates with the distance aerosol stream 6 has to travel from mist switching chamber 8 to deposition nozzle tip 10. Similarly, the inner diameters of middle mist tube 5, lower mist tube 7, and deposition nozzle 1 are preferably minimized to increase the velocity of the flow, thereby minimizing the mist transit time from mist switching chamber 8 to the outlet of nozzle tip 10. The flow control of the various flows in the system preferably utilizes mass flow controllers as shown to provide precise flows over the long durations of production runs. Alternatively, orifice-type or rotameter flow controls may be preferable for low-cost applications. Furthermore, to maximize the stability of the system and minimize transition times, M and S are preferably each maintained approximately constant at all times, including during both printing and diverting modes and during shuttering transitions.

To minimize shuttering transition times, it is preferable that the pressure in the print head remains constant during printing, shuttering, and transitions between the two. If the flow in nozzle channel 3 has a flow rate N, then preferably M+S+B=E+N. In print mode, B=0 and E=0, so N=M+S. In addition, the pressure inside sheath-boost chamber 9 is preferably maintained constant to minimize shuttering transition times. Because this pressure is determined by the back pressure from the total flow through nozzle tip 10, it is preferable that the net flow through nozzle tip 10 remains the same during all operational modes and transitions between them. Thus, during complete shuttering, E and S are preferably chosen so that N=M+S. During shuttering, E=M+f(B+S), where f is the fraction of the combined boost and sheath flows that is diverted upward, and N=M+S=(1−f)(B+S). If the flow in the device satisfies these conditions (i.e. the flow rate M of mist in nozzle channel 3 during printing is substantially replaced by (1−f)B−fS during diversion such that the total flow rate N of whatever is exiting the nozzle is constant), the sheath gas flow streamlines in nozzle channel 3 are preferably substantially undisturbed by directing boost flow B through the head to disable printing.

For a completely diverted flow, solving these equations yields E=B; thus mass flow controllers 22 and 24 preferably are set such that E=B for complete flow diversion. To ensure complete internal shuttering or diversion of the aerosol flow, the rate B of boost gas flow 44 is preferably greater than flow rate M of aerosol stream 6 flow rate; preferably approximately 1.2-2 times the aerosol stream flow rate M; and more preferably B equals approximately 2M for robust, complete mist switching in most applications.

In one theoretical example, if aerosol stream 6 has a flow rate of M=50 sccm, and sheath gas flow 32 has a flow rate S of 55 sccm, during printing the flow rate in nozzle channel 3 (and thus exiting nozzle tip 10) is M+S=105 sccm. In this mode, since the boost gas flow 44 does not enter the print head, and nothing exits exhaust outlet 2, B=E=0 (even though in actuality, as described above, to maintain stability mass flow controller 44 is set to provide 100 sccm of flow that is diverted by three-way valve 20 to flow directly to mass flow controller 42, which is also set to pass 100 sccm of flow to vacuum pump 210). When complete diversion is desired, the rate B of boost gas flow 44 (and, as derived above, rate E of exhaust flow 46) is preferably selected so that B=E=2M=100 sccm for mist diverting. During diverting or shuttering of the aerosol stream, the combined sheath and boost flows having a total flow rate of S+B=155 sccm split within sheath-boost chamber 9 such that effectively N=105 sccm of the combined flow flows downwards through lower mist tube 7 and deposition nozzle 1, replacing aerosol stream 6 (and sheath flow 32) that are now being diverted in mist switching chamber 8. Because E is set to 100 sccm in mass flow controller 22, 50 sccm of the split combined flow flows upwards, flushing the residual aerosol stream 6 from the middle mist tube 5 and into the switching chamber 8 where it combines with the diverted aerosol flow. Therefore, exhaust flow 46 exiting exhaust outlet 2 will be equal to the aerosol stream flow rate M plus the upward portion of the boost gas flow rate, or E=100 sccm. The total flows into the printhead (M+B+S=205 sccm) equals the total flows out of the printhead (N+E=205 sccm). Typically, balanced flows allow for a constant pressure inside the sheath-boost chamber 9, which leads to complete turning on and off (i.e. shuttering of) the aerosol stream with minimized shuttering times.

Hybrid Shuttering

Internal pneumatic shuttering by diverting the aerosol stream to exhaust outlet 2 can occur for long periods of time without adverse effects, contrary to mechanical shuttering, where ink accumulation on a mechanical shutter inserted to block the aerosol flow can dislodge and foul the substrate or aerodynamic surfaces of the print head. The internal pneumatic shutter can be used alone or in combination with another shuttering technique, such as mechanical shuttering, to take advantage of the faster response of the mechanical shuttering while minimizing the ink accumulation on the top of the mechanical shutter arm. In this embodiment, when stopping the printing the mechanical shutter is activated to block the aerosol flow. Pneumatic shuttering as described above diverts the ink away from mechanical shutter 220 for the majority of the shuttering duration, thus reducing ink buildup on the mechanical shutter. Because the pneumatic shutter activates more slowly when compared to the faster mechanical shutter, the pneumatic shutter is preferably triggered at a time such that the faster mechanical shutter closes first, and the pneumatic shutter closes as soon as possible thereafter. To resume printing, the pneumatic shutter is preferably opened first to allow the output to stabilize, then mechanical shutter 220 is opened. Although a mechanical shutter can be located anywhere within the print head, or even external to the deposition nozzle, mechanical impact shuttering preferably occurs close to where the aerosol stream exits the deposition nozzle.

Transient Shuttering

In an alternative embodiment of the current invention, the internal shutter can be used as a transient shutter, for which diversion of the aerosol flow occurs for a short enough period that the aerosol distribution in the print head does not have time to equilibrate. FIG. 2 shows the aerosol distribution immediately after switching three-way valve 20 to add boost gas flow 44 to sheath-boost input 4 and pull exhaust flow 46 from exhaust port 2. The gap in the aerosol created in sheath-boost chamber 9 expands downward thru lower mist tube 7 and upward thru middle mist tube 5.

Figure 5:
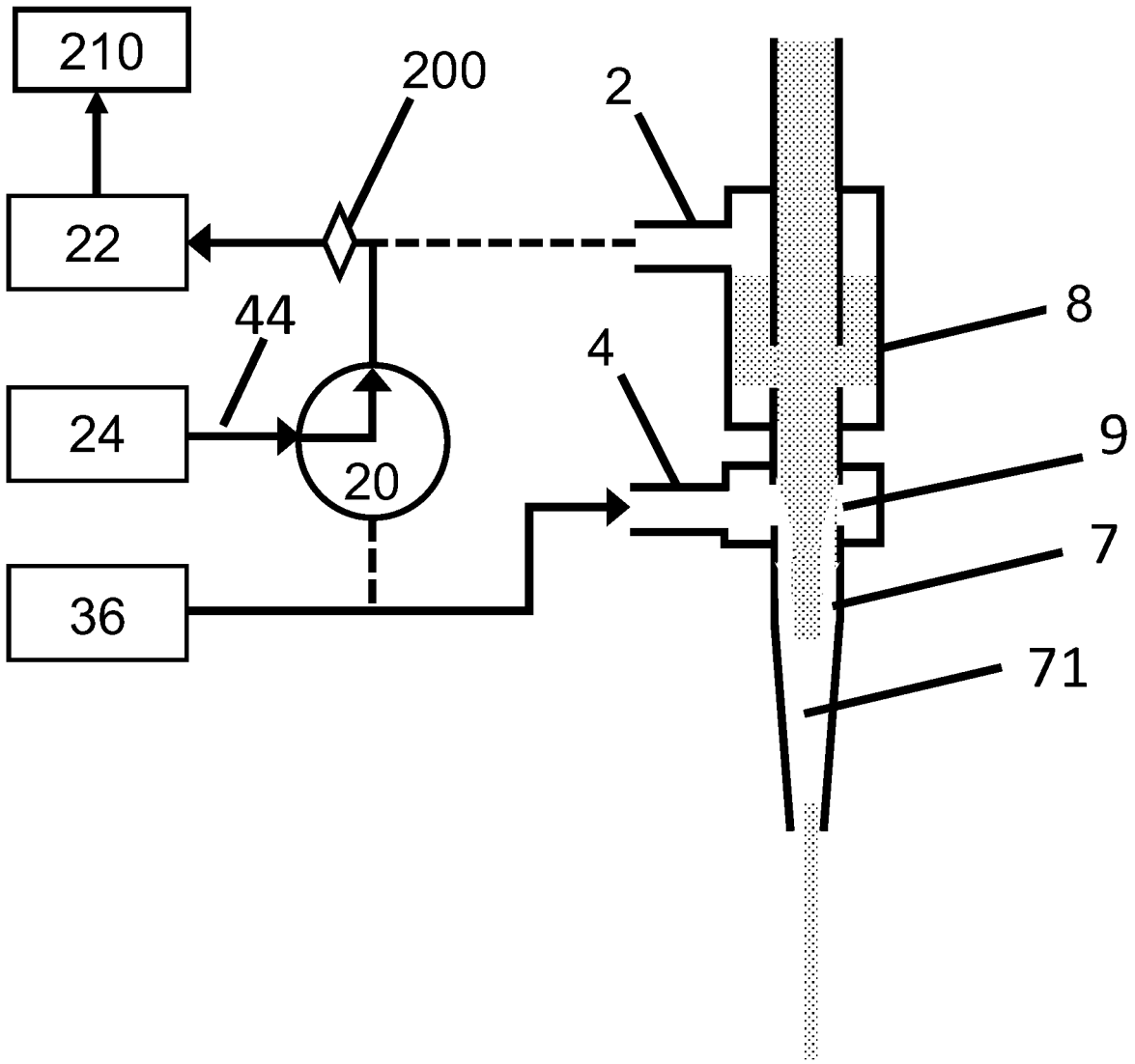
FIG. 5 is a schematic of the flows in the device of FIG. 1 when printing is resumed after transient shuttering.

As shown in FIG. 5, when three-way valve 20 is rapidly switched back to diverting boost gas flow 44 so that it does not enter the print head, the mist in middle mist tube 5 again travels down across sheath-boost chamber 9 and into the lower mist tube 7. The gap 71 in the aerosol flow can be very short, on the order of 10 ms, and transitions to fully off and fully on can occur very quickly. It is preferable that the upward-moving clean gas remain within middle mist tube 5 so that when the downward flow is restored it flows downward symmetrically with the upward flow pattern. That is, just as the higher velocity near the center of the upward flow created an upward bulge of clean gas in middle tube 5 as shown in FIG. 2, the high-velocity center flow of the returning mist collapses the bulge and creates a substantially planer mist front as the mist emerges from the bottom of middle tube 5. Thus, just as the aerosol flow was abruptly cut by the flow of clean gas in sheath-boost chamber 9 at the beginning of the diversion, when printing resumes the leading boundary of the downward flow of aerosol preferably reforms to make a substantially abrupt entrance into sheath-boost chamber 9, creating a short initial-to-full turn-on time at the substrate. If while diverting the leading surface of the clean gas emerges from the top of middle tube 5 into mist switching chamber 8, the clean gas disperses laterally into the chamber. When aerosol flow is resumed the clean gas does not return entirely to middle mist tube 5, and the initial-to-full turn-on-time of the mist is degraded. The residence time of the clean gas in the middle mist tube 5 is determined by the relation of the volume of the tube to the upwards flow rate of the clean gas. Lower upward flow rates, for example B=E=1.2M, are typically used to create slow upward flows. The length or diameter of middle mist tube 5 can be increased to increase the residence time of the clean gas in the middle tube and the duration of the permissible divert. Transient shuttering greatly reduces shuttering time and improves shuttering quality when printing patterns with short gaps in aerosol output such as repetitive dots or lines with closely-spaced ends.

Partial Shuttering

Figure 6:
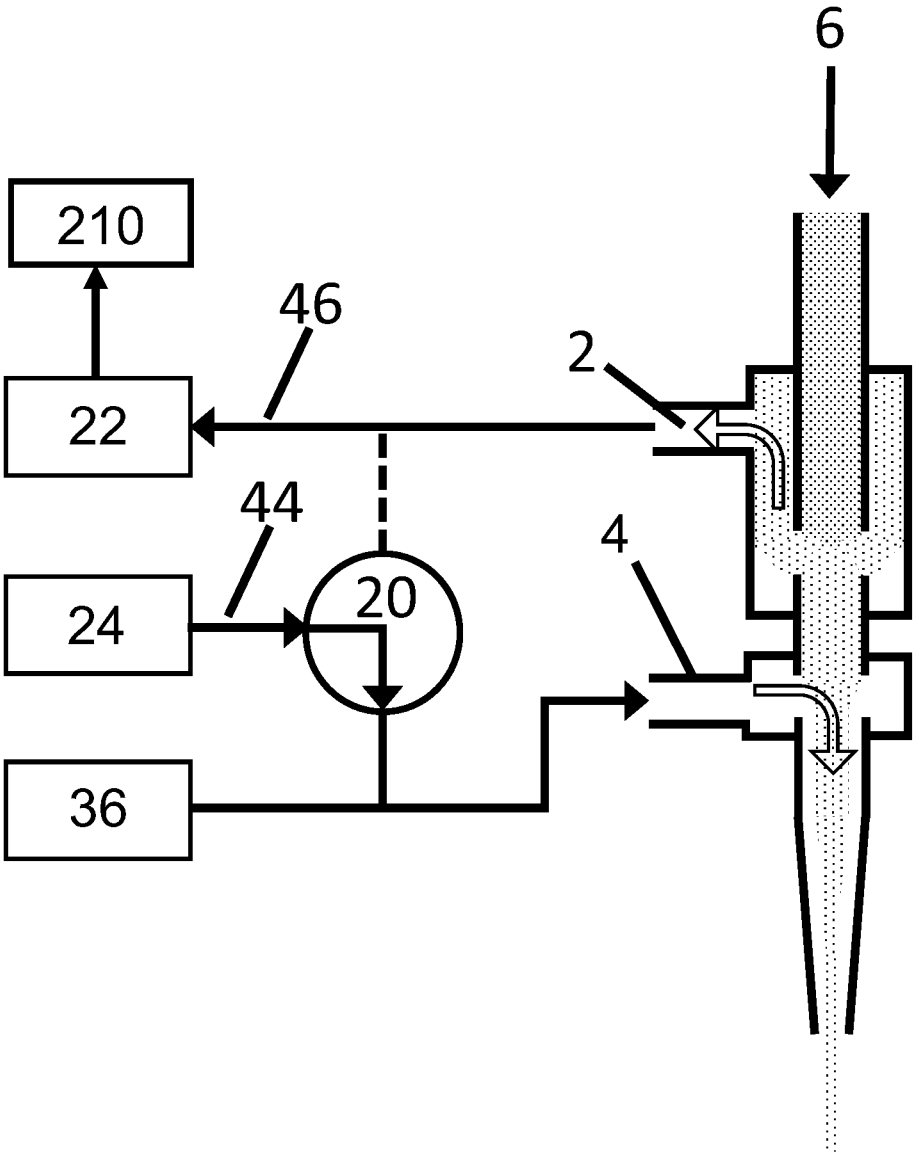
FIG. 6 is a schematic of the flows in the device of FIG. 1 during partial shuttering (i.e. partial diversion).

High aerosol flow rates M are typically used to provide a large mass output of ink and create coarse features, whereas low flow rates are typically used to create fine features. It is often desirable to print large and fine features in the same pattern, e.g. when a fine beam is used to trace the perimeter of a pattern and a coarse beam is used to fill in the perimeter, while keeping M constant. In an alternative embodiment of the present invention shown in FIG. 6, the internal shutter can be used to partially divert aerosol stream 6 flow to change the mist flow rate toward the deposition nozzle by diverting a fraction of the mist to exhaust outlet 2 while printing. Thus some of aerosol flow 6 is always being diverted out of exhaust port 2, even during printing, with only a portion of the mist passing into middle tube 5. The effective mist flow rate and printed line widths can be varied by changing the balance between the exhaust flow rate E, the boost gas flow rate B, and the mist flow rate M. When fully diverting, the boost flow B is preferably greater than or equal to the mist flow M, as described above. If B is less than M, some mist will still travel down middle mist tube 5 and out deposition nozzle 1 and the aerosol will only be partially diverted.

In one theoretical example, it is desired that half of the aerosol stream is diverted and half is printed. If aerosol stream 6 has a flow rate of M=50 sccm, and sheath gas flow 32 has a flow rate S of 55 sccm, for partial shuttering, rate B of boost gas flow 44 is selected in this example so that B=½M=25 sccm. Mass flow controller 22 is set so that E=65 sccm, so that the combined sheath and boost flows having a total flow rate of S+B=80 sccm split equally within sheath-boost chamber 9 such that 40 sccm of the combined flow flows downwards through lower mist tube 7 and deposition nozzle 1. N is thus 40 sccm+(½M)=65 sccm and the total flows into the print head (50+55+25=130 sccm) equal the total flows out of the printhead (65+65=130 sccm). Alternatively, E could be set equal to 75 sccm, in which case the combined boost and sheath flows are split so that 50 sccm flows upward (since 75−25=50) and 30 sccm flows downward. Thus N=30+25=55 sccm, and again the incoming flows (50+55+25=130 sccm) equal the outgoing flows (75+55=130 sccm). It is noted that for partial shuttering, E>B, and the system equilibrates to a pressure (130 sccm) lower than that which occurs during full shuttering (205 sccm), and higher than that which occurs during normal printing (105 sccm), as shown in the prior example.

In general, B>M is used for fully diverting or shuttering or transient shuttering of the mist, preventing printing, and B<M or B=M is used to reduce the mist output during printing and create fine features. Each B with B<M will result in a different mist flow exiting deposition nozzle 1. Thus it is possible to accomplish both reducing and fully diverting the mist flow if at least two levels of boost flow can be created, one with B>M and one with B<M. This can be accomplished, for instance, by rapidly changing the settings of boost mass flow controller 24, or alternatively employing a second boost mass flow controller. In the latter case, one boost mass flow controller (MFC) could be set at a flow of, for example, 2M to completely turn off the mist, and the other set at a flow of, for example, ½M to reduce the fraction of M flowing out nozzle 1.

Using partial diversion to vary the mass output and line width is preferable to varying the incoming aerosol flow 6 rate M, because the exhaust and boost gas flows can stabilize in less than approximately one second, whereas the output of an atomizer can take longer than 10 seconds to stabilize when M is changed. Alternately, a second flow stream or orifices to split an existing flow and control valve could be used to create varying mist outputs with rapid response times.

Pre-Sheath Gas

Figure 7:
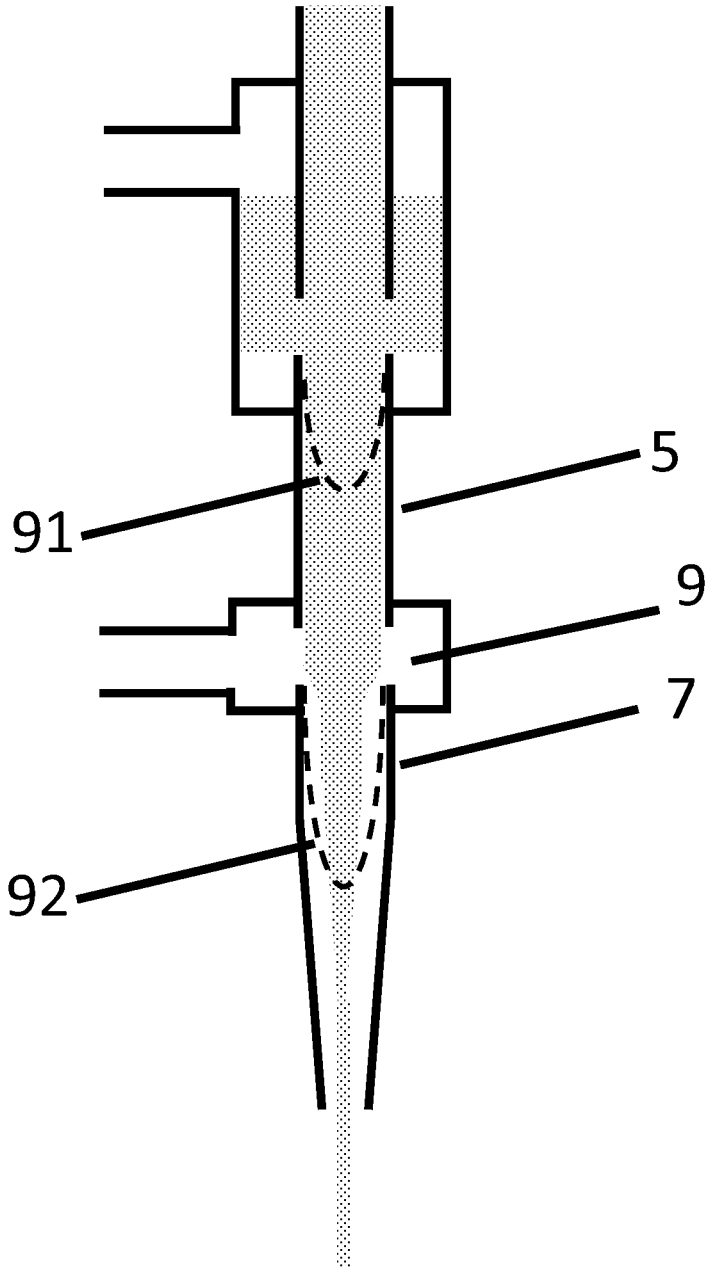
FIG. 7 is a schematic of the velocity distribution in the aerosol flow in the device of FIG. 1.

Under the laminar flow conditions normally employed in aerosol jet printing preferably performed in the present invention, the gas in cylindrical tubes forms a parabolic velocity profile with twice the average velocity in the center of the tube and near zero velocity near the walls of the tube. FIG. 4 shows the flow of aerosol being re-established after diversion where the leading edge of the mist follows this parabolic flow profile 48. The difference between the traverse time of the slow-moving mist near the walls of middle mist tube 5 and the fast-moving mist in the center of middle mist tube 5 dominates the delay between initial turn-on and full turn-on of the aerosol at the substrate. While in theory it takes an infinite amount of time for the zero-velocity mist near the walls of the middle tube to reach the sheath-boost chamber, in practice substantially full output is achieved after approximately 2-3 times the time required for the fast-moving mist to reach the sheath-boost chamber after the shutter is opened (i.e. when three-way valve 20 is switched.) FIG. 7 shows the velocity distribution 91 in middle mist tube 5 and the velocity distribution 92 in the lower mist tube 7. The velocity of the mist in the lower tube is greater than in the middle tube for two reasons: firstly, because sheath gas flow 32 has been added to aerosol stream 6 in sheath-boost chamber 9, preferably forming an axisymmetric, annular sleeve around the mist; and secondly, the mist in lower mist tube 7 is confined to the central, fast moving portion of the flow. Thus with a sheath gas flow, it is the sleeve of clean sheath gas that is near the tube wall that is moving slowly; the aerosol itself is in the high-velocity region of the gas velocity profile. Therefor there is relatively little variation in the time for the center and edges of the mist distribution to traverse lower mist tube 7 and deposition nozzle 1.

Figure 8:
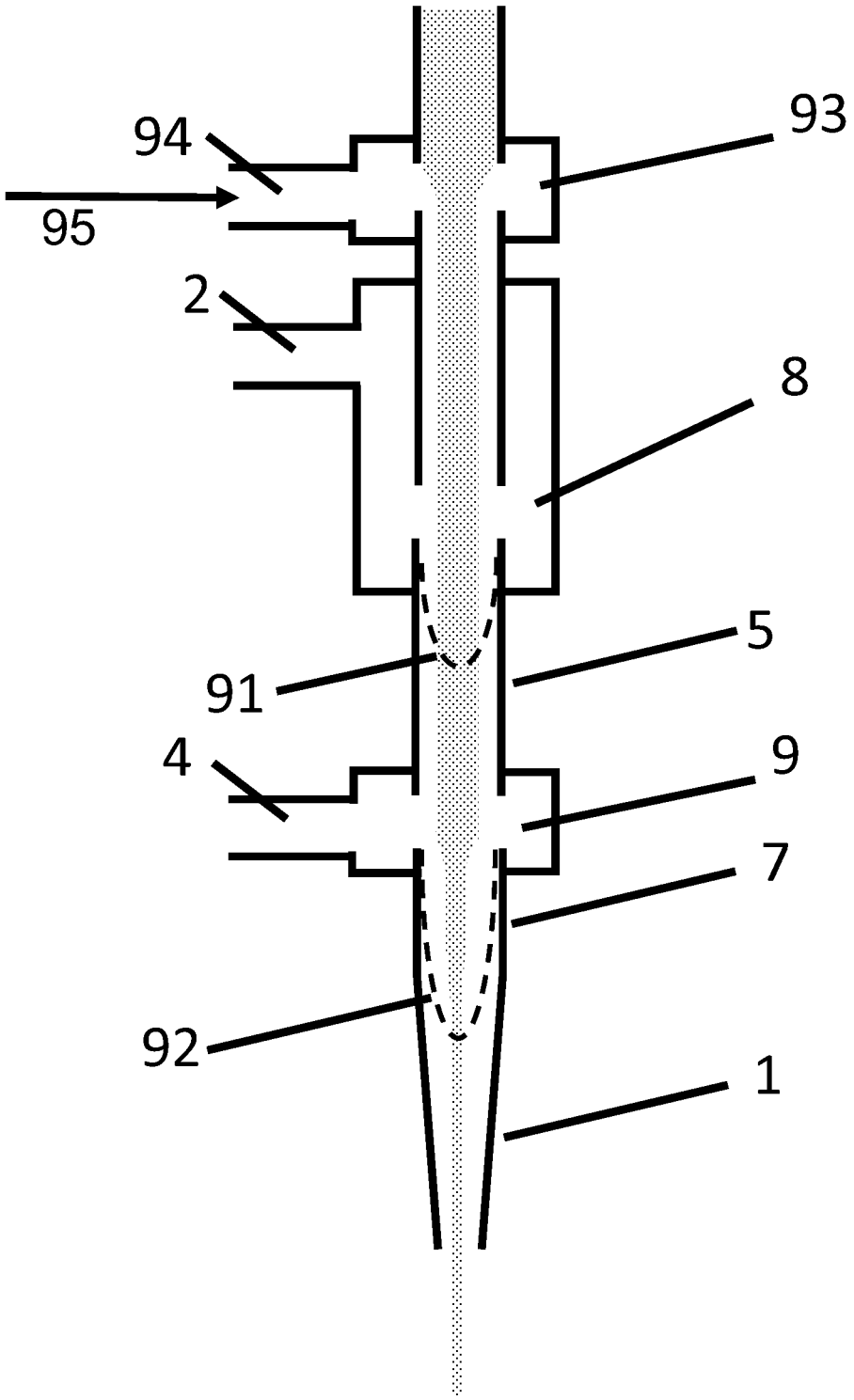
FIG. 8 is a schematic of the velocity distribution in the aerosol flow in a device similar to that of FIG. 1, but which employs use of a pre-sheath gas.

Because of this advantage, a "pre-sheath" surrounding the mist stream may be added before the mist enters mist switching chamber 8 and/or middle mist tube 5 to eliminate the slow-moving mist near the wall of middle mist tube 5. FIG. 8 shows pre-sheath gas 95 entering pre-sheath chamber 93 via pre-sheath input port 94, preferably forming an axisymmetric, annular sleeve of clean gas around aerosol stream 6. In some embodiments, approximately half of the total sheath flow is directed into the pre-sheath input port 94, and the other half is directed into the sheath-boost input port 4. Supplying 50% of the sheath flow to the pre-sheath gas flow results in an approximately 80% reduction in the delay between initial and full turn-on of the aerosol stream. As the pre-sheath and sheath flows recombine in sheath-boost chamber 9, there is little difference in the deposition characteristics on the substrate with or without employing a pre-sheath gas flow.

Note that in the specification and claims, "about" or "approximately" means within twenty percent (20%) of the numerical amount cited. As used herein, the singular forms "a," "an," and "the" include plural referents unless the context clearly dictates otherwise. Thus, for example, reference to "a functional group" refers to one or more functional groups, and reference to "the method" includes reference to equivalent steps and methods that would be understood and appreciated by those skilled in the art, and so forth.

Although the invention has been described in detail with particular reference to the disclosed embodiments, other embodiments can achieve the same results. Variations and modifications of the present invention will be obvious to those skilled in the art and it is intended to cover all such modifications and equivalents. The entire disclosures of all patents and publications cited above are hereby incorporated by reference.

What is claimed is:

1. An apparatus for depositing an aerosol, the apparatus comprising:

an aerosol supply;

a sheath gas supply;

a boost gas supply;

a vacuum pump;

a valve for connecting said boost gas supply to said sheath gas supply or said vacuum pump; and a print head, the print head comprising:

an aerosol inlet for receiving an aerosol from said aerosol supply;

a first chamber comprising a sheath gas inlet for receiving a sheath gas from said sheath gas supply; said first chamber configured to surround the aerosol with the sheath gas; and a second chamber comprising an exhaust gas outlet connected to said vacuum pump, said second chamber disposed between said aerosol inlet and said first chamber; and a deposition nozzle;

wherein said sheath gas inlet receives a combination of a boost gas from said boost gas supply and the sheath gas when said boost gas supply is connected to said sheath gas supply; and wherein said first chamber is configured to divide a portion of the combination into a first portion flowing toward said aerosol inlet and a second portion flowing toward said deposition nozzle.

2. The apparatus of claim 1 comprising a first flow controller disposed between said exhaust gas outlet and said vacuum pump.

3. The apparatus of claim 2 wherein said first flow controller is a mass flow controller, an orifice-type flow controller, or a rotameter.

4. The apparatus of claim 2 comprising a filter disposed between said exhaust gas outlet and said first flow controller.

5. The apparatus of claim 1 comprising a second flow controller disposed between said sheath gas supply and said sheath gas inlet and a third flow controller disposed between said boost gas supply and said valve.

6. The apparatus of claim 5 wherein said second flow controller is a mass flow controller, an orifice-type flow controller, or a rotameter.

7. The apparatus of claim 5 wherein said third flow controller is a mass flow controller, an orifice-type flow controller, or a rotameter.

8. The apparatus of claim 1 wherein a flow of gas entering said sheath gas inlet is in a direction perpendicular to an aerosol flow direction in said print head.

9. The apparatus of claim 1 comprising a mechanical shutter.

10. The apparatus of claim 1 comprising a third chamber disposed between said aerosol inlet and said second chamber, said third chamber comprising a pre-sheath gas inlet, said third chamber configured to surround the aerosol with a pre-sheath gas.

11. The apparatus of claim 10 comprising a flow divider connected between said pre-sheath gas inlet and said sheath gas supply, said flow divider for forming the pre-sheath gas from approximately one-half of the sheath gas.

* * * * *